US009096808B2

(12) United States Patent
Kuske et al.

(10) Patent No.: US 9,096,808 B2
(45) Date of Patent: Aug. 4, 2015

(54) GASIFICATION REACTOR FOR THE PRODUCTION OF CRUDE GAS

(75) Inventors: Eberhard Kuske, Soest (DE); Johannes Dostal, Dortmund (DE); Reinald Schulze Eckel, Muenster (DE); Lothar Semrau, Essen (DE)

(73) Assignee: ThyssenKrupp Uhde GmbH, Dortmund (DE)

( * ) Notice: Subject to any disclaimer, the term of this patent is extended or adjusted under 35 U.S.C. 154(b) by 748 days.

(21) Appl. No.: 13/387,479

(22) PCT Filed: Jul. 16, 2010

(86) PCT No.: PCT/EP2010/004338

§ 371 (c)(1),
(2), (4) Date: Mar. 20, 2012

(87) PCT Pub. No.: WO2011/012230

PCT Pub. Date: Feb. 3, 2011

(65) Prior Publication Data

US 2012/0171084 A1 Jul. 5, 2012

(30) Foreign Application Priority Data

Jul. 28, 2009 (DE) ..... 10 2009 035 051

(51) Int. Cl.
*B01J 7/00* (2006.01)
*C10J 3/52* (2006.01)
(Continued)

(52) U.S. Cl.
CPC *C10J 3/526* (2013.01); *C10J 3/506* (2013.01); *C10J 3/76* (2013.01); *C10J 3/78* (2013.01);
(Continued)

(58) Field of Classification Search
CPC ..... C10J 3/485; C10J 3/526; C10J 2200/09; C10J 3/506; C10K 1/101; C10K 1/08; C10K 1/10
See application file for complete search history.

(56) References Cited

U.S. PATENT DOCUMENTS 4,474,584 A 10/1984 Koog
4,513,694 A 4/1985 Wiemer
(Continued)

FOREIGN PATENT DOCUMENTS

CN 101061204 A 10/2007
CN 101508915 A 8/2009
(Continued)

OTHER PUBLICATIONS

International Search Report of PCT/EP2010/004338, date of mailing May 4, 2011.
(Continued)

*Primary Examiner* — Imran Akram
(74) *Attorney, Agent, or Firm* — Collard & Roe, P.C.

(57) ABSTRACT

In the case of a gasification reactor for the production of crude gas, containing CO or $H_2$, by gasification of ash-containing fuel with oxygen-containing gas, at temperatures above the melting temperature of the ash, wherein a reaction chamber formed by a membrane wall through which coolant flows, within a pressure container, subsequently a transition region and a quench chamber are provided, with a slag/water bath following in the direction of gravity, a funnel-shaped slag collection container is provided in the slag/water bath, which container is equipped, in the inflow direction of the slag, with a second funnel-shaped insert as a precipitation cone, the funnel wall of which forms a circumferential ring gap to the slag collection container, and the free border edge of which is positioned above the free border edge of the slag collection container.

3 Claims, 2 Drawing Sheets

Figure 1:
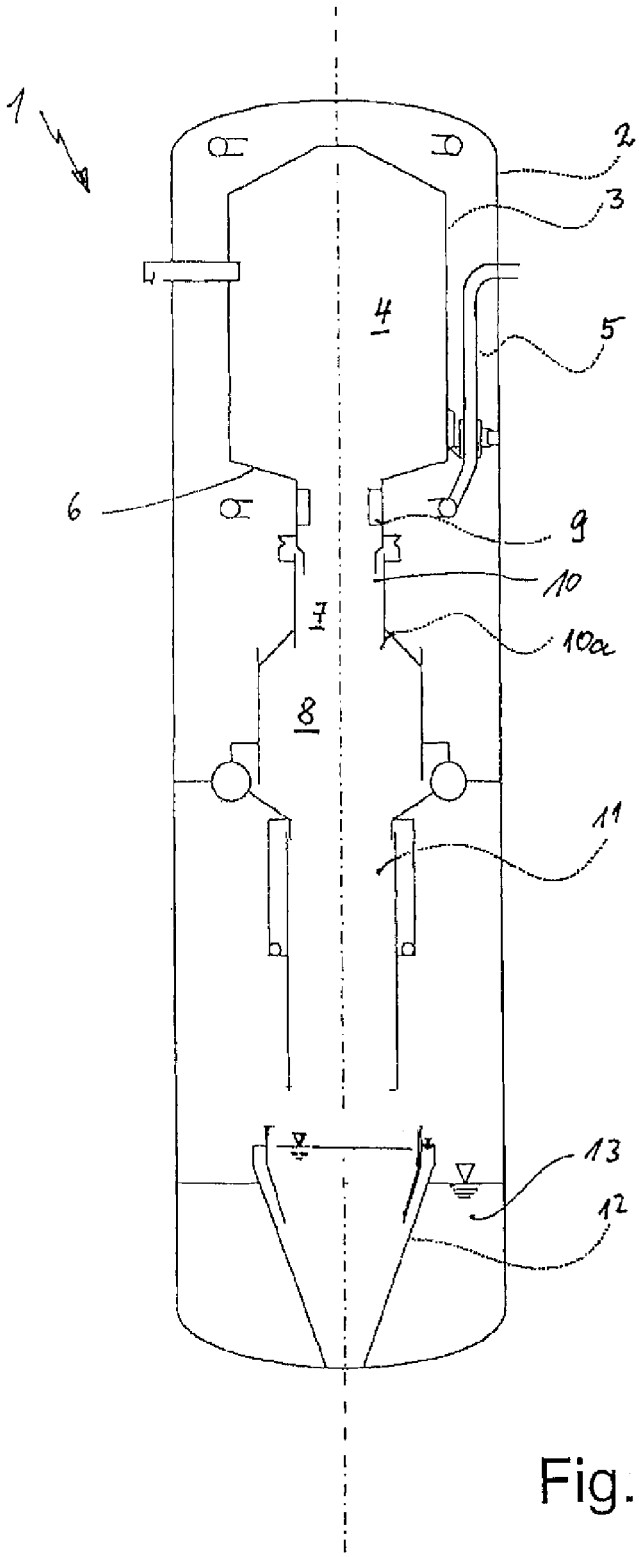

(51) Int. Cl.

| | |
|---|---|
| ***C10J 3/76*** | (2006.01) |
| ***C10J 3/84*** | (2006.01) |
| ***C10J 3/50*** | (2006.01) |
| ***C10J 3/78*** | (2006.01) |

(52) U.S. Cl.
CPC .. *C10J 3/84* (2013.01); *C10J 3/845* (2013.01); *C10J 2300/093* (2013.01); *C10J 2300/0916* (2013.01); *C10J 2300/0946* (2013.01); *C10J 2300/0956* (2013.01); *C10J 2300/0959* (2013.01); *C10J 2300/1846* (2013.01)

(56) References Cited

U.S. PATENT DOCUMENTS

| | | | | |
|---|---|---|---|---|
| 4,750,435 | A * | 6/1988 | Mayes | 110/192 |
| 4,852,997 | A | 8/1989 | Segerstrom et al. | |
| 5,248,316 | A | 9/1993 | Peise et al. | |
| 5,803,937 | A * | 9/1998 | Hartermann et al. | 48/210 |
| 7,090,707 | B1 * | 8/2006 | Barot | 48/113 |
| 8,317,885 | B2 | 11/2012 | Van Den Berg et al. | |
| 2006/0260192 | A1 * | 11/2006 | Barot | 48/197 R |
| 2010/0263278 | A1 | 10/2010 | Kowoll et al. | |
| 2010/0313442 | A1 * | 12/2010 | Russell et al. | 34/468 |
| 2011/0049256 | A1 * | 3/2011 | Schulze et al. | 239/1 |
| 2011/0162277 | A1 * | 7/2011 | Russell et al. | 48/77 |

FOREIGN PATENT DOCUMENTS

| | | |
|---|---|---|
| DE | 33 23 818 | 1/1984 |
| EP | 0 459 023 | 12/1991 |
| WO | WO 2009/036985 | 3/2009 |

OTHER PUBLICATIONS

International Preliminary Report on Patentability dated Feb. 7, 2012 and Written Opinion of the International Searching Authority of PCT/EP2010/004338.

* cited by examiner

GASIFICATION REACTOR FOR THE PRODUCTION OF CRUDE GAS

CROSS REFERENCE TO RELATED APPLICATIONS

This application is the National Stage of PCT/EP2010/004338 filed on Jul. 16, 2010, which claims priority under 35 U.S.C. §119 of German Application No. 10 2009 035 051.9 filed on Jul. 28, 2009, the disclosure of which is incorporated by references. The international application under PCT article 21(2) was not published in English.

The invention relates to a gasification reactor for the production of crude gas containing CO or $H_2$, of the type indicated in the preamble of claim 1.

Such a gasification reactor is known, for example, from WO 2009/036985 A1 by the applicant, whereby a wealth of prior art is cited in this document, such as U.S. Pat. No. 4,474,584, for example, which particularly addresses the cooling of hot synthesis gas.

In particular, the invention concerns itself with problems that occur in such reactors, whereby the invention is not restricted to the gasification reactor that is specifically addressed here; it is also directed at apparatuses in which similar problems, described in greater detail below, can occur.

Such an apparatus must be suitable for allowing methods of pressure gasification/burning of finely distributed fuels, which includes the partial oxidation of the fuels coal dust, finely distributed biomass, oil, tars, or the like in a reactor. This also includes the separate or joint withdrawal of slag or fly ash, and generated synthesis gas or flue gas. Cooling of the reaction products (gas and slag/fly ash) must be made possible, for example by spray quenching, gas quenching, radiation quenching, convective heating surfaces, or the like, depending on the type of method used, whereby finally, attention also has to be directed toward discharge of the reaction products from the pressure container.

In the document WO 2009/036985 A1, which has already been mentioned above and forms the type, a measure is already described for cooling even coarser particles, and inducing a circulating flow, in order to prevent deposits.

It is the task of the present invention, in particular, to give the slag container an economically advantageous configuration, while simultaneously multiplying the method of functioning.

This task is accomplished, according to the invention, in the case of a gasification reactor of the type indicated initially, in that a funnel-shaped slag collection container is provided in the slag/water bath, which container is equipped, in the inflow direction of the slag, with a second funnel-shaped insert as a precipitation cone, the funnel wall of which forms a circumferential ring gap to the slag collection container, and the free border edge of which is positioned above the free border edge of the slag collection container.

Because a gas/slag/cooling water mixture permanently flows into the funnel-shaped slag collection container from above, the partly double-wall design of the funnel region, according to the invention, produces an overflow stream out of the funnel-shaped insert into the surrounding water bath.

Because the free border edge of the inner cone projects beyond the funnel wall, the additional result is achieved that any turbulences of the water surface when larger slag particles occur do not lead to the result that then cooling water with overly large slag particles is carried to the outside, into the surrounding water bath.

In an embodiment, it is provided, according to the invention, that the cylinder that encloses the quench chamber has a lesser diameter than the funnel-shaped insert that forms the precipitation cone.

In this way, it is guaranteed that the incident gas/slag/water mixture already mentioned above is reliably guided into the inner funnel-shaped insert, whereby the gas can flow in the free space between the border edge of the cylinder that encloses the quench chamber, on the one hand, and the liquid surface in the funnel-shaped insert, into the surrounding free ring space, on the other hand.

The invention also provides that the ring gap formed by the conical slag collection container and the precipitation cone is dimensioned in such a manner that only particles having a predetermined maximal size can flow over the overflow edge in the slag collection container, into the water bath, which lies at a lower level.

Figure 2:
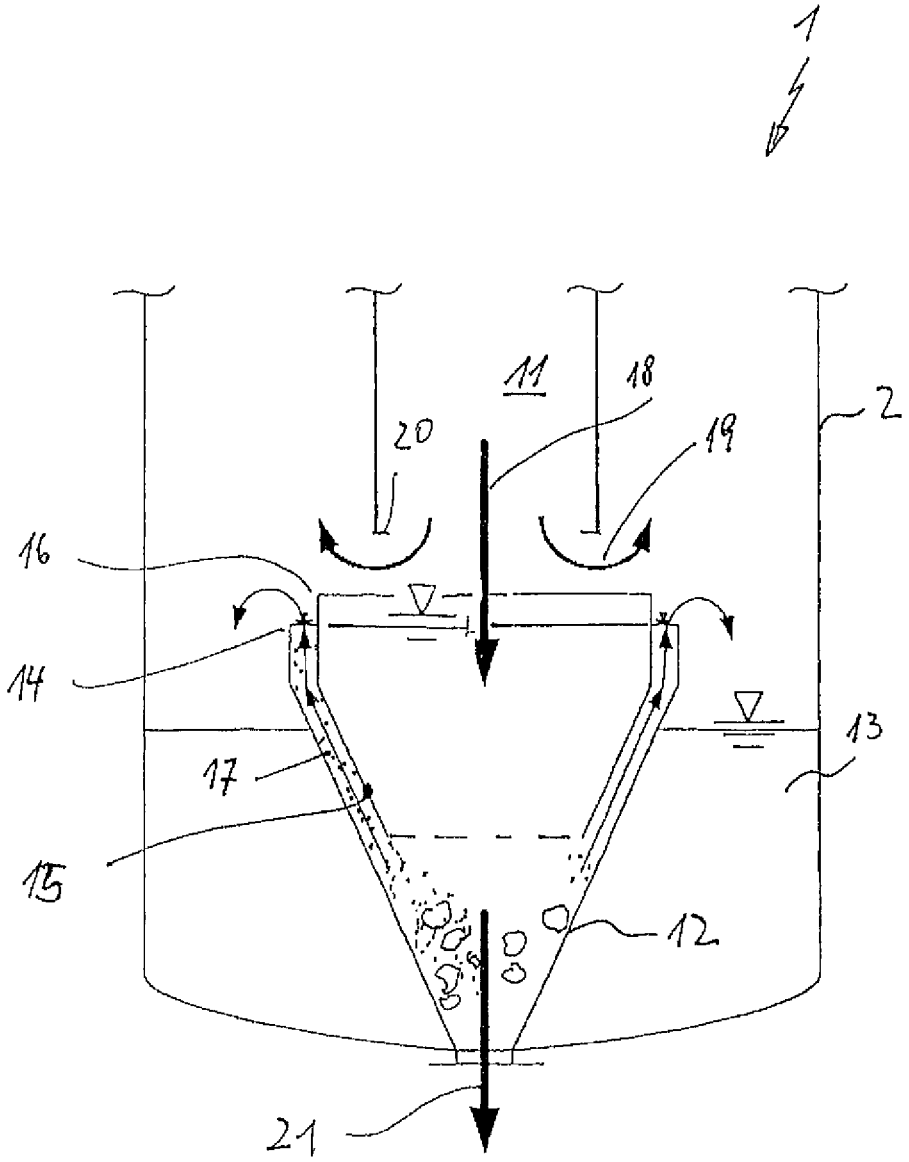

Further details, features and advantages of the invention are evident from the following description and the drawing. This shows, in:

FIG. 1 a schematic sectional drawing through a gasification reactor according to the invention, and in FIG. 2 a schematic, enlarged view of the lower part of the gasification reactor, with slag/water bath.

The gasification reactor shown in FIG. 1, generally identified as 1, has a pressure container 2, in which a reaction chamber 4 enclosed by a membrane wall 3 is disposed at a distance from the pressure container 2, from top to bottom. The coolant feed line to supply the membrane wall 3 is identified as 5. In this connection, the membrane wall 3 transitions, by way of a lower cone 6, into a narrowed channel, as part of a transitional region identified as 8, whereby spin brakes 9 are indicated in the narrowed transition channel 7. 10*a* identifies a drip edge at the transition region 8 for the liquid ash, in the transition region, at a distance from the first drip edge 10, at the end of the transition channel 7.

Following the transition region 8 is a quench chamber or quench channel 11, followed by a slag collection container 12 in a water bath 13.

As is evident from FIG. 2, a funnel-shaped slag collection container 12 is situated in the water bath 13, in the embodiment described here, the free border edge 14 of which container projects beyond the liquid level in the water bath 13.

A further funnel-shaped insert 15 is positioned concentrically in this funnel-shaped slag collection container 12, to form a precipitation cone; the free upper border edge 16 of this insert in turn projects beyond the funnel-shaped slag collection container 12.

A circumferential ring gap 17 is formed between the funnel-shaped insert 15 and the wall of the slag collection container 12. Because a gas/slag/water mixture constantly flows downward during operation of the reactor 1, out of the quench channel 11, as indicated by the arrow 18 in FIG. 2, the cooling water is moved upward through the ring gap 17 and flows over the border edge 14 into the water bath 13.

On the basis of the geometrical dimensions, i.e. in particular on the basis of the configuration of the width of the ring gap 17, the particles that are entrained through this ring gap are restricted in size, so that only corresponding solids having a size restricted in an upward direction get through this ring gap into the water bath, so that they do not unnecessarily stress or damage pumps and other conveying means.

Because the border edge 16 of the funnel-shaped insert 15 lies above the liquid level of the slag collection container 12, this configuration prevents larger particles from being able to get over the border edge 16 and possibly into the slag/water bath 13 when larger slag fragments occur and therefore the liquid surface is disturbed.

The flow of the gas around the end edge 20 of the quench channel 11 is identified with 19. The discharge of the cooled slag is symbolically shown by an arrow 21.

Of course, the exemplary embodiment of the invention that is described can be modified in many ways, without departing from the basic idea; for example, the invention is particularly not restricted to the geometric shape of the slag collection container having a funnel-shaped insert; here, a round cross-section shape can be provided, just as well, or a polygonal cross-section shape and the like more.

The invention claimed is:

1. A gasification reactor for producing crude gas, containing CO or $H_2$, by gasification of ash-containing fuel with oxygen-containing gas, at temperatures above a melting temperature of the ash, comprising:

(a) a pressure container;

(b) a reaction chamber formed by a membrane wall within the pressure container, wherein coolant flows through the membrane wall;

(c) a transition region beneath the reaction chamber;

(d) a quench chamber beneath the transition region;

(e) a slag/water bath following in a direction of gravity;

(f) a funnel-shaped slag collection container disposed in the slag/water bath having a free border container edge; and (g) a funnel-shaped insert forming a precipitation cone disposed within the slag collection container, the funnel-shaped insert having a funnel wall forming a circumferential ring gap to the slag collection container and a free border insert edge positioned above the free border container edge of the slag collection container.

2. The gasification reactor according to claim 1, wherein the quench chamber is enclosed by a cylinder having a smaller diameter than the funnel-shaped insert that forms the precipitation cone.

3. The gasification reactor according to claim 1, wherein the ring gap formed by the slag collection container and the precipitation cone is dimensioned so that only particles having a predetermined maximal size can flow over an overflow edge of the slag collection container into the slag/water bath.

* * * * *